US005503608A

United States Patent [19]

Chang

[11] Patent Number: 5,503,608

[45] Date of Patent: Apr. 2, 1996

[54] HORSE RIDING TYPE EXERCISER

[76] Inventor: Ta-Fang Chang, 1F No. 130-6 Yung-He Road, Ta-Ya Hsiang, Taichung Hsien, Taiwan

[21] Appl. No.: 490,671

[22] Filed: Jun. 15, 1995

[51] Int. Cl.[6] ..... A63B 69/06

[52] U.S. Cl. ..... 482/57; 482/95; 482/72

[58] Field of Search ..... 482/72, 96, 95, 482/51, 57, 111, 148, 123, 142; 472/106; 110/120

[56] References Cited

U.S. PATENT DOCUMENTS

| | | | |
|---|---|---|---|
| 4,300,760 | 11/1981 | Bobroff | 482/57 |
| 5,342,269 | 8/1994 | Huang et al. | 482/95 |
| 5,356,357 | 10/1994 | Wang et al. | 482/72 |
| 5,366,428 | 11/1994 | Liao | 482/96 |
| 5,370,594 | 12/1994 | Grinblat | 482/72 |
| 5,421,795 | 6/1995 | Chen | 482/96 |
| 5,458,553 | 10/1995 | Wu | 482/95 |
| 5,464,378 | 11/1995 | Yu | 482/57 |

*Primary Examiner*—Jerome Donnelly
*Attorney, Agent, or Firm*—Morton J. Rosenberg; David I. Klein

[57] ABSTRACT

A horse riding type exercise includes a base having a pin secured in the front portion and having a shaft secured on the front portion. A handle is pivotally coupled to the shaft and includes a rod secured to the middle portion and located above the shaft. A beam has a front portion pivotally coupled to the pin and includes a seat cushion secured on the rear portion and includes a front portion pivotally coupled to the rod. The beam is rotated about the pin when the handle is rotated about the shaft so as to elevate the seat cushion.

1 Claim, 4 Drawing Sheets

HORSE RIDING TYPE EXERCISER

BACKGROUND OF THE INVENTION

1. Field of the Invention

The present invention relates to an exerciser, and more particularly to a horse riding type exerciser.

2. Description of the Prior Art

Typical horse riding type exercisers are disclosed in U.S. Pat. No. 5,342,269 to Huang et al. issued on Aug. 30, 1994; U.S. Pat. No. 5,356,357 to Wang et al. issued on Oct. 18, 1994; U.S. Pat. No. 5,356,358 to Chen issued on Oct. 18, 1994; and U.S. Pat. No. 5,366,428 to Liao issued on Nov. 22, 1994. The handle bars thereof may be pulled for conducting horse riding type exercises. However, the typical horse riding type exercisers comprise a rather complicated configuration.

The present invention has arisen to mitigate and/or obviate the afore-described disadvantages of the conventional horse riding type exercisers.

SUMMARY OF THE INVENTION

The primary objective of the present invention is to provide a horse riding type exerciser which includes a greatly simplified configuration.

In accordance with one aspect of the invention, there is provided an exerciser comprising a base including a middle portion having a cusp formed thereon and including a front portion having a pin element provided thereon, and including a front end having a bar provided thereon, a pair of posts extended upward from the bar and including an upper portion having a shaft provided thereon, a handle including a lower portion pivotally coupled to the shaft, including a bottom end having a pair of foot pedals secured thereto, including an upper portion having a hand grip means provided thereon, and including a middle portion having a rod secured thereon and located above the shaft, and a beam including a front portion pivotally coupled to the pin element, including a rear portion having a seat cushion provided thereon, and including a bent portion extended from the front portion, the bent portion being pivotally coupled to the rod. The beam is caused to rotate about the pin element when the handle is rotated about the shaft, so as to elevate the seat cushion.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
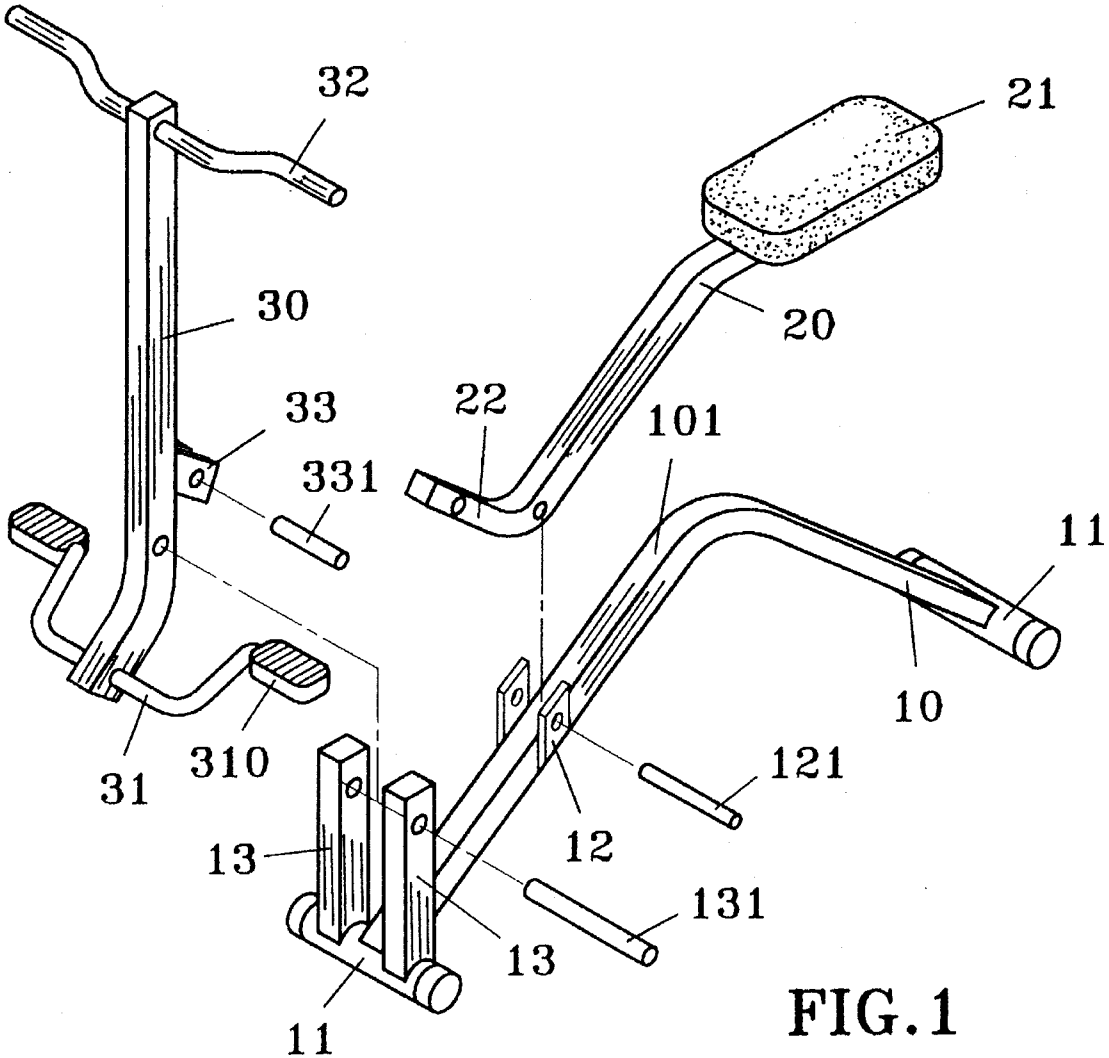
FIG. 1 is an exploded view of an exerciser in accordance with the present invention.
Figure 2:
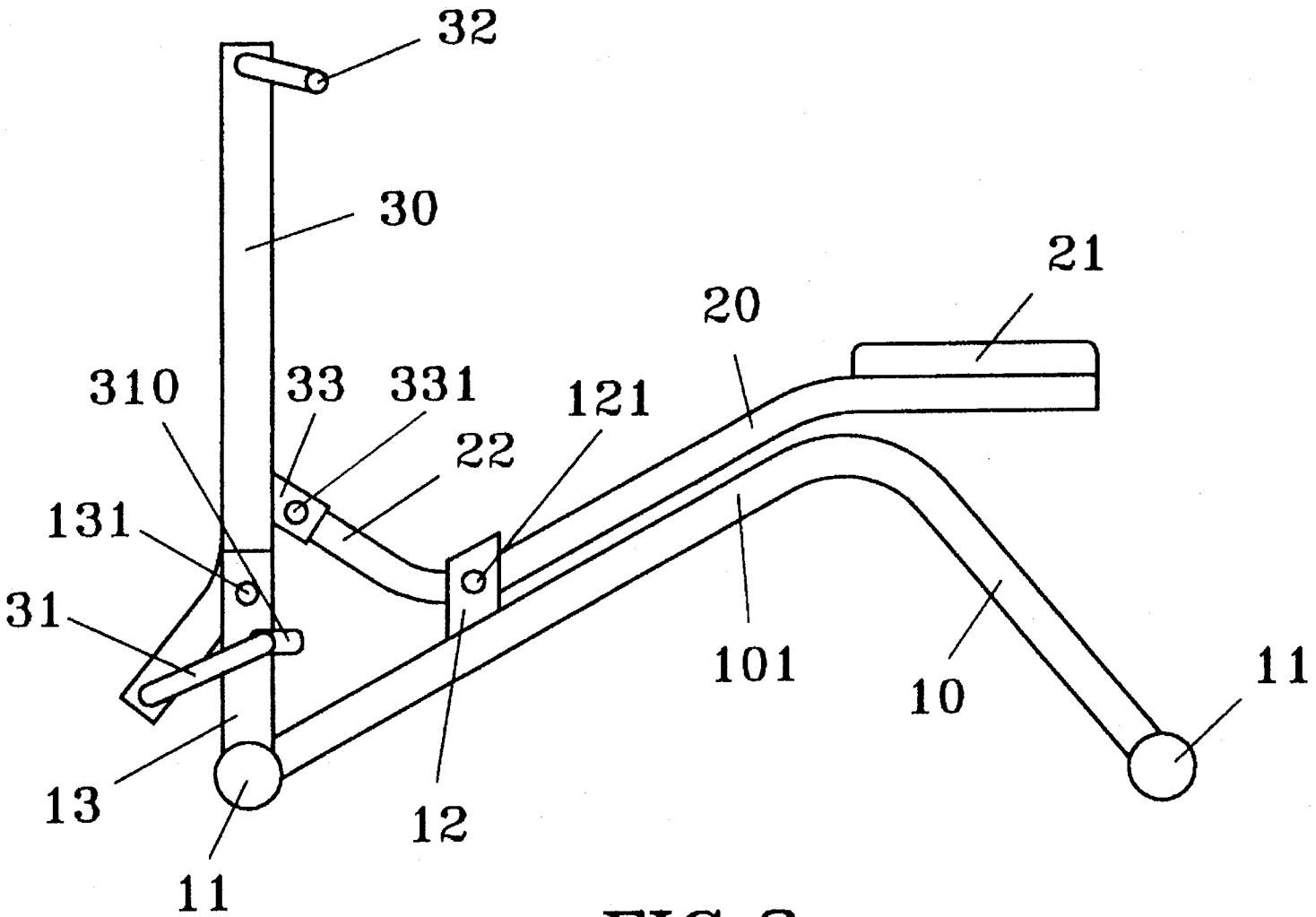
FIG. 2 is an elevation view of the horse riding type exerciser.
Figure 3:
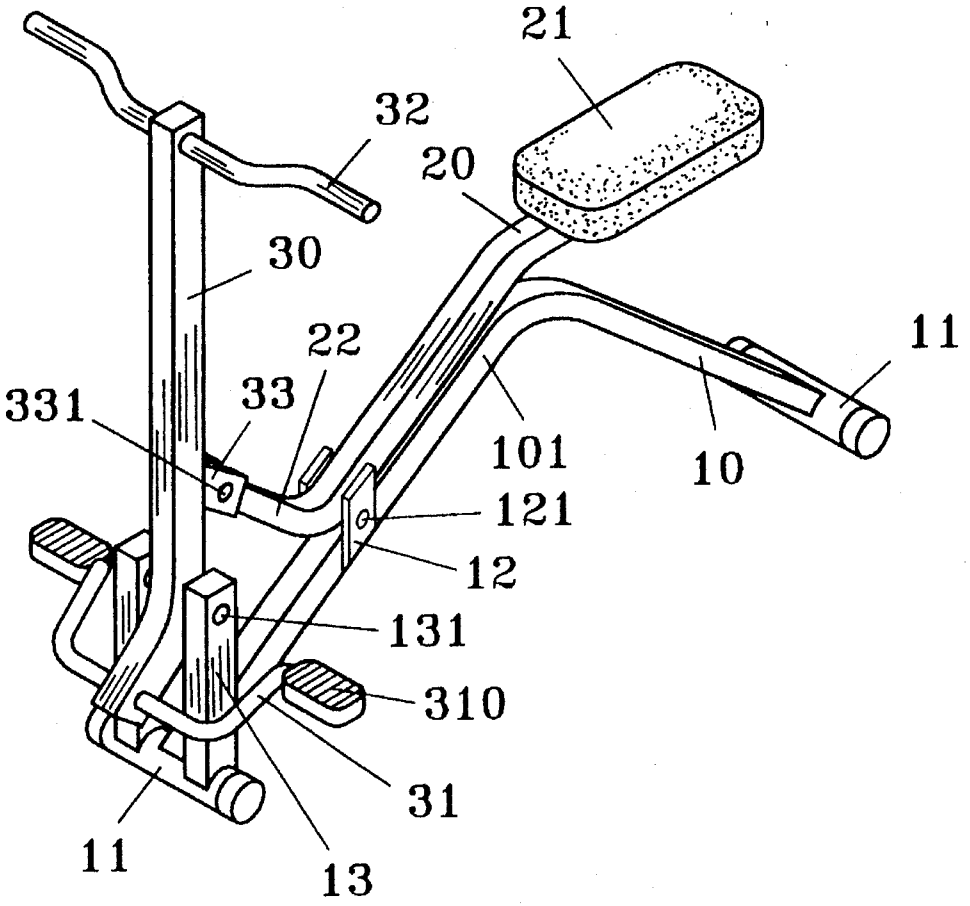
FIG. 3 is a perspective view of the horse riding type exerciser.

Referring to the drawings, and initially to FIGS. 1 to 3, a horse riding type exerciser in accordance with the present invention comprises a base 10 including a inverted V-shape frame element having a cusp 101 formed in the middle portion and having a pair of bars 11 provided on the end portions so as to form a stable configuration. A pair of lugs 12 are provided on the front portion of the base 10 for engaging with a pin element 121. A pair of posts 13 are extended upward from the front bar 11 and include an upper portion for engaging with a shaft 131.

A handle 30 includes a lower portion pivotally coupled to the shaft 131 and includes a hand grip 32 provided on top thereof and includes a foot support 31 secured to the bottom portion thereof for supporting a pair of foot pedals 310 thereon. The handle 30 includes a pair of ears 33 provided in the middle portion for engaging with a rod 331 and arranged such that the rod 331 is located above the shaft 131. A beam 20 includes a middle portion pivotally coupled to the pin element 121 and includes a seat cushion 21 provided on the rear and upper portion such that the seat cushion 21 may be moved upward and downward when the beam 20 rotates about the pin element 121. The beam 20 includes a bent portion 22 formed in the front portion and extended forward and upward therefrom, the bent portion 22 is pivotally coupled to the rod 331.

Figure 4:
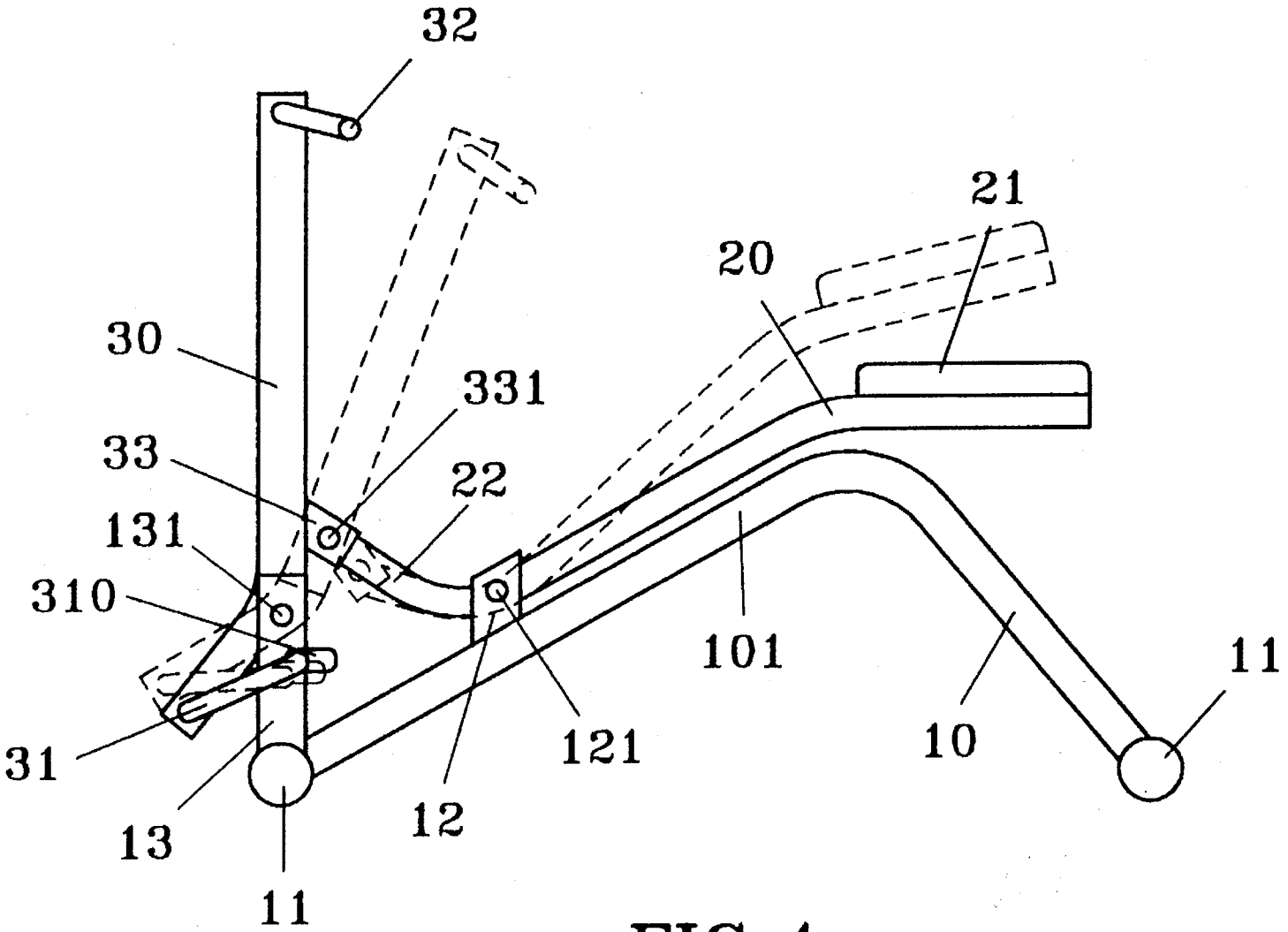
FIG. 4 is an elevation view illustrating the operation of the horse riding type exerciser.

In operation, as shown in FIG. 4, when the hand grip 32 of the handle 30 is pulled toward the user and/or when the foot pedals 310 are depressed by the users, the beam 20 is caused to rotate counterclockwise such that the seat cushion 10 21 may be caused to move upward against the user and such that the user may simulate pull type horse riding type exercises.

Accordingly, the horse riding type exerciser in accordance with the present invention includes a greatly simplified configuration that is excellent for manufacturing purposes and is excellent for storing and transportation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding exerciser comprising:

a base including an inverted V-shaped frame element having a cusp formed in a middle portion thereof and including a front portion having lug means attached thereto for supporting a pin element, and a front end having a bar provided thereon;

a pair of posts connected to and extending upwardly from said bar and including an upper portion having a shaft extending therethrough;

a handle including a lower portion pivotally coupled to said shaft, a bottom end of said handle having a pair of foot pedals secured thereto, an upper portion having a hand grip member provided thereon and a middle portion including ear members having a rod secured thereto, said rod being located above said shaft when said handle is positioned in a vertical orientation;

a beam including a front end, a front portion of said beam pivotally coupled to said pin element, a rear portion of said beam having a seat member provided thereon, said beam including a bent portion formed in said front portion of said beam and extending forwardly and upwardly therefrom, said front end being pivotally coupled to said rod, and, said beam being rotatably displaceable about said pin element when said handle is rotated about said shaft, for elevating said seat.

* * * * *